US006857710B2

(12) United States Patent
Bolen

(10) Patent No.: US 6,857,710 B2
(45) Date of Patent: Feb. 22, 2005

(54) SECURE MERCHANDISE-VENDING MACHINE

(75) Inventor: Richard K. Bolen, Champaign, IL (US)

(73) Assignee: The Northwestern Corporation, Morris, IL (US)

( * ) Notice: Subject to any disclaimer, the term of this patent is extended or adjusted under 35 U.S.C. 154(b) by 0 days.

(21) Appl. No.: 09/954,771

(22) Filed: Sep. 18, 2001

(65) Prior Publication Data

US 2003/0052577 A1 Mar. 20, 2003

(51) Int. Cl.[7] ..... A47F 1/00

(52) U.S. Cl. ..... 312/35; 194/350; 221/154

(58) Field of Search ..... 312/35; 221/281, 221/265, 282–286, 287–250, 154; 232/15; 194/350, 258; 70/158–162, 379 R, 380, 78–81

(56) References Cited

U.S. PATENT DOCUMENTS

| | | | | | |
|---|---|---|---|---|---|
| 2,627,362 | A | * | 2/1953 | Balaz | 221/154 |
| 2,696,324 | A | * | 12/1954 | Jones | 221/20 |
| 3,028,049 | A | * | 4/1962 | Sidney | 221/154 |
| 3,783,986 | A | * | 1/1974 | Bolen | 194/350 |
| 3,804,294 | A | * | 4/1974 | Householder | 221/154 |
| 3,822,004 | A | * | 7/1974 | Bolen Jr. | 221/265 |
| 4,534,492 | A | * | 8/1985 | Schwarzli | 221/203 |
| 4,679,684 | A | * | 7/1987 | Glaser | 194/350 |
| 5,131,519 | A | * | 7/1992 | Ra | 194/350 |
| 5,190,133 | A | * | 3/1993 | Bolen | 194/350 |
| 5,647,471 | A | * | 7/1997 | Ra | 194/350 |
| 5,984,171 | A | * | 11/1999 | Schwarzli | 194/350 |

FOREIGN PATENT DOCUMENTS

| | | | | |
|---|---|---|---|---|
| EP | 0274414 | * | 7/1988 | 221/154 |
| FR | 2599263 | * | 12/1987 | 221/281 |

* cited by examiner

*Primary Examiner*—Lanna Mai
*Assistant Examiner*—Hanh V. Tran
(74) *Attorney, Agent, or Firm*—Lewis T. Steadman; Holland & Knight LLP

(57) ABSTRACT

A bulk merchandise-vending machine with a base supporting a merchandise storage member, a mechanism plate positioned to form a closure member for the base and removable therefrom by a forward pivotal movement about its bottommost edge while the storage member is tilted slightly upwardly about its rearmost edge, wherein the front of the storage member is provided with a locking element cooperative with a lock carried by the mechanism plate and operable positively to prevent the storage member from tilting about its rear lower edge and separate from the mechanism plate, whereby unauthorized access to the mechanism carried by the mechanism plate and/or a coin receptacle there behind is positively prevented.

3 Claims, 1 Drawing Sheet

SECURE MERCHANDISE-VENDING MACHINE

BACKGROUND OF THE INVENTION

This invention relates to improvements in merchandise bulk vending machines in which the coins introduced for the merchandise are dropped into a cash box mounted in the base of the machine and a plate carrying a rotary coin mechanism is positioned to close a portion of the base. The machine described and claimed herein is a specific improvement over Applicant's basic Model 80 marketed for many years by Northwestern Corporation of Morris, Ill. The most recent embodiment of that Model 80 is disclosed in U.S. Pat. No. 6,182,859B1 issued to the inventor of the present invention, the disclosure of which is incorporated by reference herein. The Model 80 vending machine comprised a supporting base member having side and rear walls rigidly connected to each other and leaving an operable front wall formed as a mechanism plate pivotable about its lowermost edge on the front floor of the base. When the mechanism plate is pivoted forwardly about its bottom edge, access to a cash box located behind the mechanism plate, in the base, is provided.

In normal operation, the mechanism plate cannot be pivoted forwardly since its uppermost edge is retained by a lip or retaining element at the lower forward edge of the merchandise storage container positioned immediately above the base. The storage container, or member, comprises a four sided box, the sides of which are typically transparent to permit viewing of the storage contents. The storage member is provided with a closure top and is fixedly secured to the base member by way of a centrally located rod passing from the bottom of the base upwardly through the storage container and thence through the top by way of a locking mechanism that, when locked, prohibits upward movement of the top and/or the storage member relative to the base. During collection of coins from the Model 80, the lock at the top is unlocked, the storage container is tilted upwardly around its rear lower edge relative to the base, and, upon vertical separation of the lower front edge of the storage member from the top of the mechanism plate, the mechanism plate is pivoted forwardly about its lower edge, revealing the cash box there behind.

The Model 80 vending machine has been nicknamed, in the trade, as the "Crack-Back" machine because of its construction which provides for the tilt-back of the storage container about its rear edge, which lifts up the lower front edge thereof permitting the mechanism plate to move forwardly. Ordinarily, the lock at the top of the storage member prevents such separation but it has been found in actual practice, over the years, that a blow or force, applied to the top edge of the storage member can sometimes permit vertical separation between the bottom front edge of the container and the top of the mechanism plate. This permitted unauthorized access to the cash box, and the pilfering of the valuable contents thereof.

SUMMARY OF THE INVENTION

In accordance with the present invention, a separate interrelated, locking member is provided for mechanically securing the lowermost front edge of the storage container to the base thereby positively locking the two together and preventing any relative movement between the mechanism plate and the storage container, thereby preventing unauthorized access to the rear of the mechanism plate and/or the cash box. The key for this security lock may preferably comprise an uncommon type providing high security foreign to this field of vending machines.

It is therefore an important object to the present invention to provide an improved merchandise vending machine that is much more secure against unauthorized access to the coin storage box.

Another object of the present invention is to prevent unauthorized access to the mechanism of the vending machine.

A further object of the present invention is to provide merchandise vending machine having a merchandise storage container and a mechanism plate supporting the coin mechanism, constructed such that the merchandise plate cannot be removed without first conventionally unlocking the storage container at the top thereof and also unlocking an anti-pilfering lock.

In summary, Applicant here provides a coin controlled merchandise/vending machine comprising a merchandise storage container or member, a supporting pedestal and base having a front opening comprising a coin accepting merchandise dispensing mechanism which is pivotally mounted about the forward bottom edge of the base. Behind the mechanism carrying plate, the space within the base is occupied by a coin box. The mechanism plate is provided with a lip cooperating with the rear surface of a downwardly projecting edge of the front rim of the merchandise storing container, such that vertical separation between those two elements is required to permit the mechanism plate to be tilted forwardly. In accordance with the present invention, positive locking elements are provided preventing any unauthorized separation between the storage container and the mechanism plate so that improper pivotal opening movement of the plate cannot occur under any circumstance.

BRIEF DESCRIPTION OF THE DRAWINGS

For the purpose of facilitating the understanding of the invention, the accompanying drawings illustrate embodiments thereof, from an inspection of which, in combination with the following description, the invention, its mode of construction, assembly and operation, and its advantages over the prior art will be readily understood.

Referring to the drawings in which the same characters of references are employed to indicate the corresponding parts throughout several figures of the drawings.

DETAILED DESCRIPTION OF THE PREFERRED EMBODIMENTS

Figure 1:
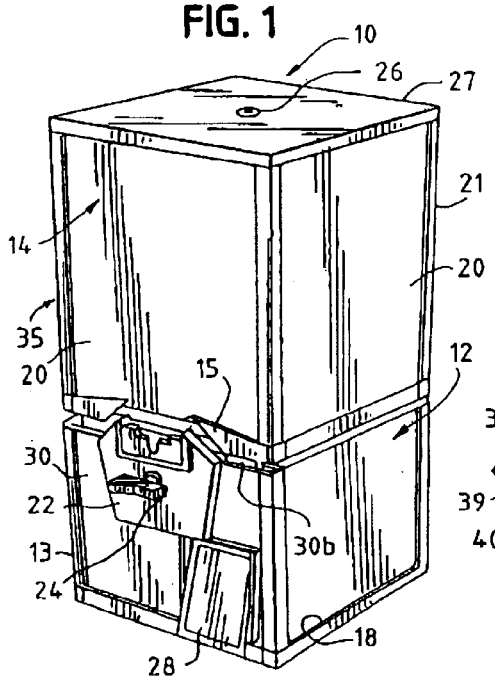
FIG. 1 is an isometric view of the assembled bulk vending machine as found in the prior art and partially disassembled.
Figure 2:
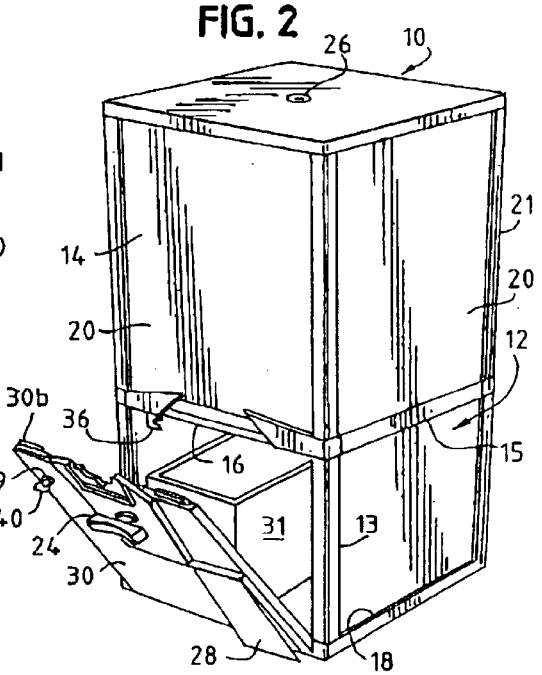
FIG. 2 is an isometric view of an embodiment of the present invention showing the front mechanical plate tilted forwardly.
Figure 3:
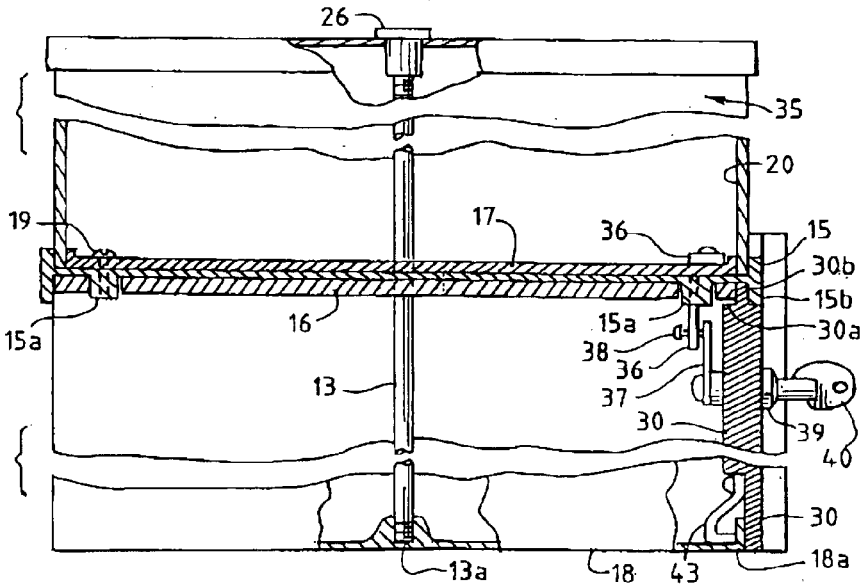
FIG. 3 is a partial side elevational cut-away view illustrating, in detail an embodiment of the case lock construction according to the present invention.

In FIG. 1 a bulk vending machine 10 is, essentially, a modified Model 80 bulk vending machine as manufactured and distributed by The Northwestern Corporation of Morris, Ill. One embodiment of this prior art vending machine is illustrated in U.S. Pat. No. 6,182,859B1 issued Feb. 6, 2001. The machine 10 includes a base housing 12 and a storage container member 14. The housing 12 is preferably formed from a top frame portion 16 and a base frame portion 18. The frames 16 and 18 are rigidly secured together at the corner posts 13. The container 14 comprises a hopper frame adapter 15 which supports a hopper 17 and four rigid corner posts 21 secured rigidly thereto for cooperation with and positioning four clear Plexiglas panels 20. As shown in FIG. 3, the hopper 17 is secured to frame 15 by screws 19 threaded into downwardly extending bosses 15*a*. The bosses act to position frame 15 relative to the top frame 16, and the rear bosses 15*a* cooperate with the inner rear edge of the frame 16 to act as a pivot when force is applied to the front top of container 14.

The container 14 may be removably affixed to the base housing 12 by a vertically ascending, mounting rod 13 which may be threadedly, or otherwise, secured to the base frame 18, typically in a central position of the base frame 18 as at 13*a*. The rod is threaded at its upper end and cooperates with a conventional keyed, locking member 26 which acts against the top lid, 27 of the container 14 to snuggly secure the container 14 to the base portion 12 by acting to force the lid 27 downwardly against the Plexiglas plates 20 which bottom against the container frame 15. In turn, the frame 15 acts against the top frame 16 of the housing 12, and thence against the base frame 18. In this assembled, rigid condition, the vending machine has, in the prior art, been in condition for display and distribution of merchandise.

In the prior art Model 80 machine a mechanical front plate 30 has been provided with mechanism 22 for accepting coins and thereafter mechanically dispensing, upon actuation of handle 24, materials confined in the container 14 downwardly through the door 28, to a customer. In the prior art Model 80, the front plate, or wall, 30 is pivotally mounted about the bottom front edge of the base frame 18 as at 43. Coins exiting the coin mechanism are dropped into a coin box 31 positioned inside the base housing 12, resting on the base plate, or frame, 18 behind the pivoted mechanism plate 30. In order to remove coins from the box shown at 31, the mechanism plate must be pivoted forwardly about its lower edge, and removed, or tilted forwardly far enough to allow removal of the coin box 31, forwardly through the opening provided by tilting the plate 30. Of course, in the clamped, locked, vending condition described above, the mechanism plate cannot be tilted forwardly. In this position, forward motion is prevented by downwardly projecting lip 15*b* on the front of frame 15 which interlocks with lips 30*b* on the plate 30. In order to permit such forward movement, the storage container 14 must be tilted backwardly about its lower rear edge sufficient to allow the mechanism plate interlock with the frame lip 15*a* to be disconnected. It has been found that while ordinarily the lock 26 acting through the top cover 27 sufficiently rigidly secures the container 14 to the base 12, occasionally during assembly in the field, the condition of the lock 26 is somewhat loose and the application of a manual jarring force in the direction of arrow 35 can tilt the container backwardly and upwardly sufficient to allow the plate to be released as illustrated in FIG. 1. Also, the cover 27 is conventionally constructed of sheet metal which can be deflected downwardly adjacent the lock 26 when forced, to, allow the release described. It has been found, in the field, that unauthorized forcing, and tilting, of the storage bin 14 about its rear, with the resultant release of the mechanism plate and hence access to the coin box, has resulted in significant monetary loss to the operators of these bulk vending machines.

In accordance with the present invention, a locking mechanism is provided for rigidly interconnecting the container adapter frame 15 to the mechanism plate 30 and the base top frame element 16. This connection is made in accordance with the preferred embodiment of the present invention by providing a metal latching hook 36 on top of the merchandise hopper 17, passing through the hopper 17 and the frame 15 to project downward into the interior of the base housing 12. This relationship is clearly illustrated in the enlarged partial cross-sectional view of FIG. 3 where the latch hook 36 extends downwardly to provide contact with cam arm 37 carrying locking element 38 which is rotated into an edge slot on latch hook 36 by rotation of the lock key 40 immediately prior to the removal of the key from the mechanism plate lock 39.

It will be understood that the locking cam 37 mounted on plate 30 can, in cooperation with the latch 36 only physically maintain the lowermost position of the hopper adapter frame 15 relative to the base 12 if the mechanical plate 30 is maintained in fixed relationship to the base frame 18 via the posts 13. In the arrangement illustrated, the upper rear edge of the mechanism plate, shown at 30(*a*) extends under the top frame element 16, which is in turn rigidly secured to the base 12. At the same time that the mechanical plate 30 moves backwardly under the front edge of the top 16, the upwardly extending locating ridge 30(*b*) is positioned behind the lowermost front edge of the hopper adapter frame 15 where it is confined when the hopper adapter frame 15 is locked in its downward position by the lock 39. Accordingly, the plate 30 cannot move upwardly when in its assembled, vending, condition, because of the constraint by the base top frame 16 and cannot move forwardly because of restraint by the downwardly projecting lip of hopper adapter frame 15. This locking mechanism is extremely rigid and it has been found that no amount of force applied to the storage container, or bin 14 can raise the frame 15 sufficiently to permit the mechanical plate to be tilted forwardly exposing the coin box or the dispensing mechanism.

The preferred embodiment illustrated above provides for the lock element 39 to be positioned in the front face of the mechanical plate 30. This position is preferred, since in many bulk vending machine installations, a plurality of machines are positioned side by side on a single supporting frame. In that situation, the sides of the individual bulk vending machines are adjacent to each other and a lock positioned in the side, adjacent to front edge of the base frame 12 could be inaccessible. However it is within the scope of the present invention to provide a locking element 39 extending into the internal housing area of base 12 from adjacent the front edge of a side wall of base 12, for locking contact with the projecting latch 36. In that case, of course, the edge opening of the latch 36 would be positioned to accept the thus modified movement of the cam 37 and locking element 38. Likewise, the plate 30 may be hinge pinned or mechanically interlocked to the base frame 18 rather than utilize cooperation of edge 30*a* with frame 16 to secure plate 30 to the base. It will of course, be apparent to those skilled in the art that further embodiments may be made within the scope of the present invention, and it is intended that the scope of the invention be limited solely by the appended claims.

What is claimed is:

1. In a bulk vending machine having a base having peripheral walls and a top frame rigidly secured with the base enclosing a coin box on a plurality of sides and supporting a merchandise container having peripheral side walls secured to a container frame, a deflectable lid covering said merchandise container, a first lock securing the mid portion of said lid to said base for resisting upward separation of said container from said base, said base having a vertical front wall pivotally mounted about a bottom front edge of the base and interlocking with a downwardly projecting lip of said container frame when the container frame is not separated from said base top frame and providing coin box access when said container frame and said base top frame are vertically separated, the improvement comprising in combination therewith a second lock by-rigidly connected with said base when said second lock is locked in engagement with a latch member carried by said container frame adjacent the front thereof with said container frame resting snuggly on top of the base top frame thereby positively securing said container frame to said base and preventing unauthorized upward lifting separation of said container frame relative to said vertical wall.

2. The structure according to claim 1, wherein said second lock is mounted on said base front wall and said base front wall is secured against vertical movement relative to said base by said top frame when in vending condition.

3. The structure according to claim 2, wherein said base front wall is constrained against vertical movement when in vending condition by extending beneath and interlocking with the top frame member rigid with said base.

* * * * *